US006722928B1

(12) United States Patent
Noda et al.

(10) Patent No.: US 6,722,928 B1
(45) Date of Patent: Apr. 20, 2004

(54) PRESS-FIT PIN FOR USE IN A PRINTED CIRCUIT BOARD

(75) Inventors: Atsuhito Noda, Hachioji (JP); Shigeyuki Hoshikawa, Yamato (JP)

(73) Assignee: Molex Incorporated, Lisle, IL (US)

( * ) Notice: Subject to any disclaimer, the term of this patent is extended or adjusted under 35 U.S.C. 154(b) by 869 days.

(21) Appl. No.: 08/921,943

(22) Filed: Aug. 27, 1997

(30) Foreign Application Priority Data

Sep. 20, 1996 (JP) ..... 8/271793

(51) Int. Cl.[7] ..... H01R 13/42
(52) U.S. Cl. ..... 439/751; 439/82
(58) Field of Search ..... 439/82, 751, 873, 439/752

(56) References Cited

U.S. PATENT DOCUMENTS

| | | | | |
|---|---|---|---|---|
| 4,464,009 A | | 8/1984 | Thaler | 339/252 R |
| 4,585,293 A | | 4/1986 | Czeschka et al. | 339/221 |
| 4,758,187 A | | 7/1988 | Guglhor | 439/741 |
| 4,762,498 A | | 8/1988 | Harting et al. | 439/82 |
| 4,795,378 A | | 1/1989 | Tomizu et al. | 439/751 |
| 4,854,900 A | | 8/1989 | Muhlhoff | 439/751 |
| 4,867,710 A | | 9/1989 | Harting et al. | 439/757 |
| 4,878,861 A | * | 11/1989 | Kendall et al. | 439/82 |
| 4,954,103 A | | 9/1990 | Liebich et al. | 439/751 |
| 5,035,659 A | | 7/1991 | Peterson | 439/751 |
| 5,738,550 A | | 4/1998 | Sakuraoka et al. | 439/751 |

FOREIGN PATENT DOCUMENTS

| | | | |
|---|---|---|---|
| DE | 4002486 C2 | 8/1991 | H01R/9/09 |
| DE | 40 02 486 A1 | 8/1991 | H01R/9/09 |
| EP | 0 262 563 A1 | 4/1988 | H01R/9/09 |
| EP | 0367660 | 10/1989 | H01R/9/09 |
| EP | 0 367 660 A2 | 5/1990 | H01R/9/09 |
| JP | 58-1547572 | 10/1983 | H01R/9/09 |
| JP | 59-150185 | 10/1984 | H01R/9/09 |
| JP | 60-230372 | 11/1985 | H01R/9/09 |
| JP | 62-41677 | 3/1987 | H01R/9/09 |
| JP | 62-49872 | 3/1987 | H01R/9/09 |
| JP | 62-49873 | 3/1987 | H01R/9/09 |
| JP | 63-237371 | 10/1988 | H01R/9/09 |
| JP | 3-16219 | 4/1991 | H01R/9/09 |
| JP | 3-79166 | 8/1991 | H01R/9/09 |
| JP | 4-87165 | 3/1992 | H01R/9/09 |
| JP | 4-160773 | 6/1992 | H01R/9/09 |
| JP | 4-102572 | 9/1992 | H01R/9/09 |
| JP | 4-73271 | 11/1992 | H01R/9/09 |
| JP | 5-166556 | 7/1993 | H01R/9/09 |
| JP | 5-211073 | 8/1993 | H01R/9/09 |
| JP | 7-245131 | 9/1995 | H01R/9/09 |

* cited by examiner

*Primary Examiner*—P. Austin Bradley
*Assistant Examiner*—Briggitte R. Hammond
(74) *Attorney, Agent, or Firm*—Robert J. Zeitler

(57) ABSTRACT

An improved press-fit pin having an elastically deformable area 6 to be press-fitted in a selected through hole in a printed circuit board, the elastically deformable area 6 comprising two parallel, opposite beams 8 connected by an connecting deformable bridge 9, thereby permitting the outer corners 8*a* of each beam 8 to engage the inner wall of the plated through hole while permitting the connecting deformable bridge 9 to be deformed. The connecting deformable bridge 9 comprises, in cross-section, an connecting flat section 10 extending perpendicular to the opposite beams 8, and two oblique sections 11 extending outward from the opposite ends of the upper flat 10*a* of the connecting flat section 10 to be contiguous to the opposite beams 8. The press-fit pin has a connecting flat section in its pressure-deformable area in place of the "V"-shaped area of a conventional press-fit pin, thus eliminating the necessity of forming acute angles in the die-and-punch.

21 Claims, 4 Drawing Sheets

6

6

PRESS-FIT PIN FOR USE IN A PRINTED CIRCUIT BOARD

FIELD OF THE INVENTION

The present invention relates to a press-fit electrical connector pin having a compliant portion for press-fit connection to a plated-through hole in a printed circuit board.

BACKGROUND OF THE INVENTION

Terminal pins with compliant sections or portions (sometimes called press-fit pins) have been known in the art for many years. Compliant pins are designed to be inserted into a plated-through hole in a printed circuit board or other conductive plate.

The pin generally includes a mating portion adapted to contact an electrically conductive element and a compliant portion extending from the mating portion and adapted to make electrical contact with conductive material defining the interior surface of the plated-through hole. The compliant portion is generally configured with one or more hinge areas that bend or flex as the pin is inserted in the hole, allowing the pin to compress to fit into the hole. The pin is thereby retained within the hole by frictional engagement between the pin and the hole walls, creating a solder-free electrical connection between the pin and the conductive interior surface of the hole.

One type of press-fit pin, as shown in U.S. Pat. No. 4,464,009 FIG. 6, has a compliant portion with a cross section configured in the shape of an "M." A pair of substantially parallel elastically deformable beam members makes up the outside leg portions and a "V"-shaped cross member interconnects the beams therebetween. The "V"-shaped cross member of the "M" configuration allows the press-fit section of the pin to resiliently deform when the pin is inserted into the board hole. The "V"-shaped cross member also allows the pin to accommodate variances in hole diameter while maintaining a low insertion force.

Such a pin can be stamped from sheet metal using a punch-die combination. Typically, the die has a female recess with a "V"-shaped angular area, the punch having similar configurations. Because of the acute angles in "V"-shaped areas, this type of punch-die is more susceptible to damage and wear and consequently is expensive to maintain.

The "V"-shaped cross member gives the press-fit portion flexibility which allows the pin to accommodate variations in the printed circuit board hole diameter. A slight variation in the metal thickness of the "V"-shaped member can affect the flexibility of the press-fit portion which can affect the frictional engagement forces between the pin and the hole walls. Consequently, variations in the mechanical characteristics of the pin can affect electrical performance. Therefore, it is desirable during manufacturing that the metal thickness of the "V"-shaped member is held constant. The "V" shape, however, makes it difficult to measure the exact thickness of the metal at this critical location. It would be desirable to provide a press-fit pin with consistent mechanical characteristics that is easy to manufacture.

SUMMARY OF THE INVENTION

The present invention provides an elongated connector pin, fabricated of electrically conductive material and adapted to be press-fitted into a plated-through hole of a printed circuit board to make a solder-free electrical connection, with consistent mechanical characteristics that is easily manufactured. To attain these objects the press-fit portion of the present invention has a cross section which has a flat section in its beam-to-beam cross member, thereby eliminating the necessity of forming acute angular areas in the dies and punches.

More specifically, the press-fit pin of the present invention has an elastically deformable area to be inserted into a plated through hole in a printed circuit board. The elastically deformable area comprises two opposite, parallel beam regions connected by a connecting deformable bridge. The outer corners of each beam region engage the inner wall of the plated through hole while permitting said connecting deformable bridge to be deformed. The present invention is an improvement in that the cross-section of the elastically deformable area includes a deformable bridge with a flat section extending perpendicular to said parallel-beam regions, and two oblique sections extending outward from the opposite ends of the upper surface of said flat section to be contiguous with said parallel beam regions. The flat section of the bridge replaces the "V"-shaped area of the conventional press-fit pin, thus eliminating acute angles in the die-and-punch and facilitating measurement of metal thicknesses at the flat section.

The connecting deformable bridge may have, on the under-side (or lower surface), a reentrant section formed at each corner transferring from each end of the connecting flat section to the inner rising wall of each beam region. The particular reentrant shape of transfer corner eliminates all acute angles from the press-fit pin.

The press-fit pin of the present invention is further improved in that the upper flat surface of the connecting deformable bridge is located at an intermediate level of the bean height. The positioning of the upper flat surface 10*a* at the intermediate level of the beam height allows the four outer corners 8*a* of the opposite beams 8 to apply same contact pressures to the inner wall of the plated through hole. The flatness of the bridge facilitates the measuring of its thickness, thereby permitting production of press-fit pins of one and same shape by lots, and hence one and same physical characteristics by lots.

Other objects and advantages of the present invention will be understood from the following description of a press-fitting pin according to a preferred embodiment of the present invention:

DESCRIPTION OF THE PREFERRED EMBODIMENT

Figure 1:
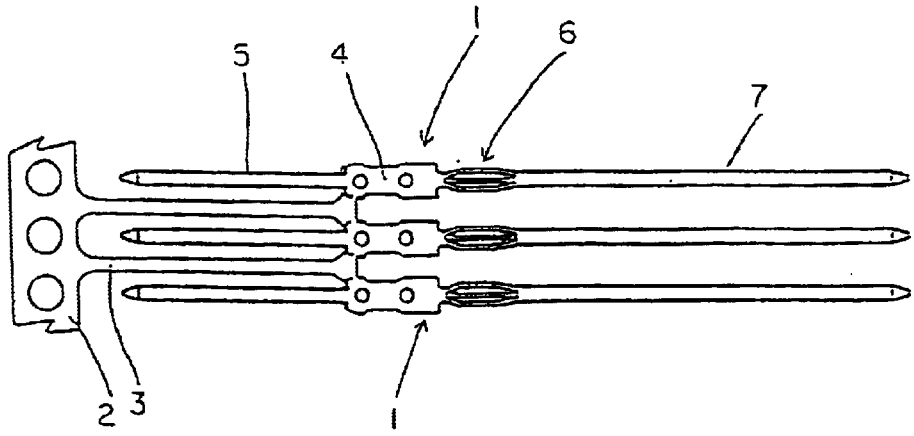
FIG. 1 is a plane view of the three press-fit pins connected to a carrier strip.
Figure 2:
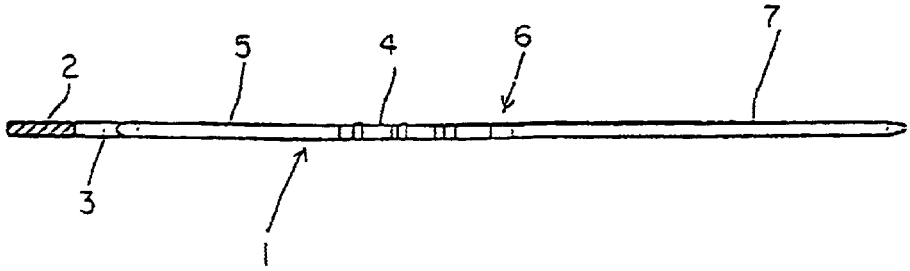
FIG. 2 is a side view of the press-fit pin.

Referring to FIGS. 1 and 2, a plurality of press-fit pins 1 are stamped out from a thin metal sheet in such a form that they are parallel-connected to a carrier 2 by associated joints 3. As seen from these drawings, the press-fit pin 1 comprises a rectangular base section 4, a first leg section 5 integrally connect to and extending from one side of the rectangular base section 4, and a second leg section 7 integrally connected to and extending from the other side of the rectangular base section 4. The second leg section 7 has a pressure-deformable area, or web 6 close to the base section 4. This pressure-deformable area 6 can be elastically deformed when the second pin section 7 is inserted into a plated through-hole of a printed-circuit board (not shown).

Figure 3:
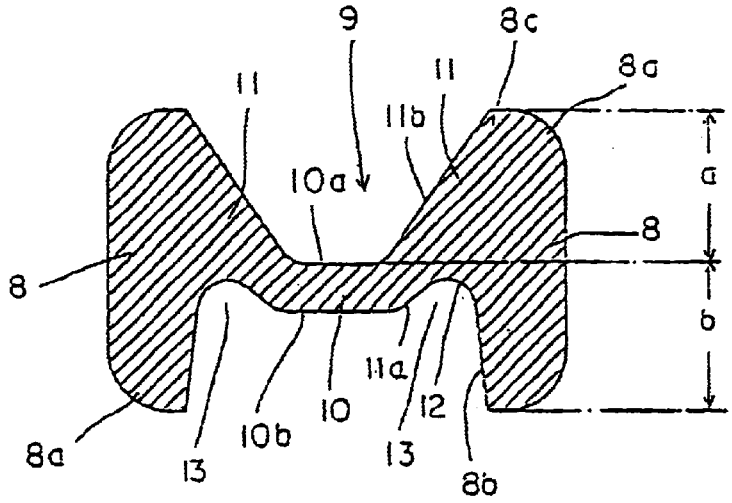
FIG. 3 is an enlarged, cross-section of the pressure-deformable area of the press-fit pin.

Referring to FIG. 3, the pressure-deformable area 6 comprises, in cross-section, a connecting flat section 9 extending perpendicular to the parallel, opposite beams, or flanges, 8, two oblique sections 11 extending outward from the opposite ends of the upper flat 10*a* of the connecting flat section 9 to be contiguous to the parallel, opposite beams 8, and two reentrant sections 12 and 13 formed at the corners transferring from the opposite ends of the lower flat 10*b* of the connecting flat section 9 to the inner rising walls 8*a* and 8*b* of the opposite beams 8. The region above the upper surface defines an upper trough and the region below the lower surface defines a lower trough. The pressure-deformable area 6 can be elastically deformed to allow the outer curved corners 8*a* of the opposite beams 8 to abut on the inner wall of a plated conductive through hole while the press-fitting pin is inserted in the through hole.

The upper flat surface 10*a* is parallel to the lower flat surface 10*b*, and the upper flat surface 10*a* lies at the intermediate level between the top and bottom of the beam 8 go("a"="b").

Figure 4:
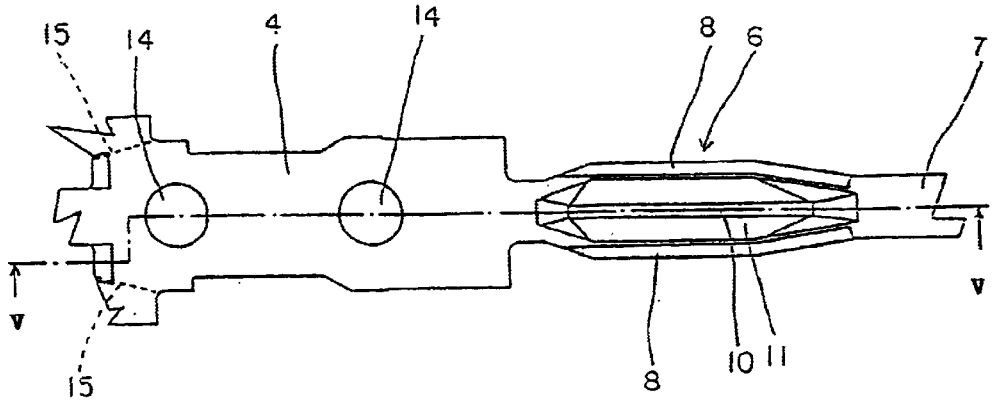
FIG. 4 is an enlarged, plane view of the base and consecutive, pressure-deformable area of the press-fit pin.
Figure 5:
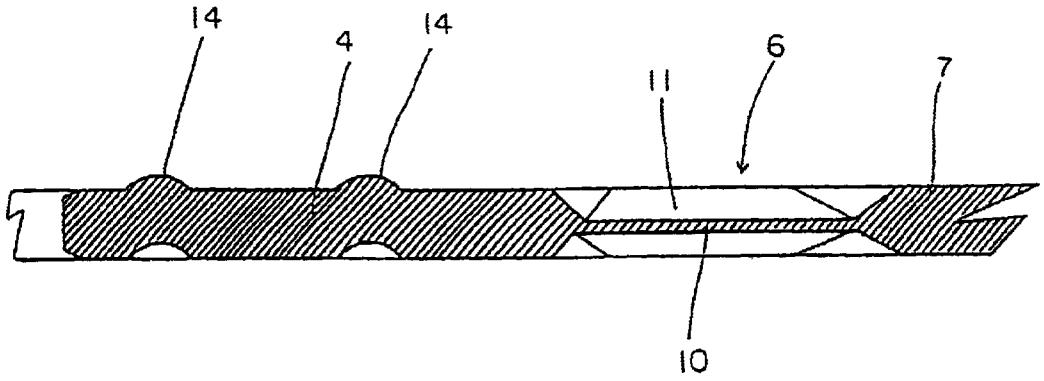
FIG. 5 is a longitudinal section of the base and consecutive, pressure-deformable area of the press-fit pin.

Referring to FIGS. 4 and 5, the base section 4 of the press-fit pin 1 has two dimples 14 formed thereon thereby to increase its rigidity. The press-fit pin 1 is cut along broken lines 15 to be separated from the connecting branches 3 of the carrier stem 2 (See FIG. 1).

As described above with reference to FIG. 3, the connecting flat section 9 extends perpendicular to the parallel, opposite beams 8, and two oblique sections 11 extend outward from the opposite ends of the connecting flat bridge 10 to be contiguous to the opposite beams 8. Thus, the thickness of the flat bridge 10, which determines the contact pressure applied to the inner wall of the through hole and other critical factors, can be exactly measured with ease. Therefore, the stroke of the stamping punch can be controlled appropriately for producing press-fit pins with consistent mechanical characteristics and quality.

The die-and-punch have no acute angles in shape, and as such have no fragile areas, therefore extending use life of die-and-punch. It is possible that the oblique extension 11*a* from each end of the lower flat 10*b* be contiguous straight-away to thinner surface 8*a* or 8*b* of each beam 8, not following the concave surface 12 as shown in FIG. 3. Then, the acute angle fief appears on either end of the lower flat 10*b*, and accordingly the die must have acute angles formed therein. The preferred embodiment however, has no acute angles, therefore the punch has no acute angles formed therein, and as a result the punches and dies can have extended life.

Although various minor modifications may be suggested by those versed in the art, it should be understood that this application is intended to cover any variations, uses or adaptations of the invention, following in general the principles of the invention.

What is claimed is:

1. A press-fit pin having an elastically deformable area to be press-fitted in a plated through hole in a printed circuit board, the elastically deformable area comprising:

two generally parallel, opposite beams;

a deformable bridge extending perpendicular to said beams, said deformable bridge having, in cross-section, a flat upper surface and a flat lower surface, said flat upper surface and said flat lower surface having opposite ends;

said upper surface of said deformable bridge being joined to said beams by two oblique sections extending outward and upward from said opposite ends of said upper surface of said deformable bridge; and said lower surface of said deformable region having reentrant sections formed at said opposite ends of said lower surface of said deformable region, and opposite sidewalls extending from said reentrant sections generally outward and downward to be contiguous with said opposite beams.

2. A press-fit pin according to claim 1 wherein said upper surface of connecting deformable bridge is at an intermediate level of the beam height.

3. A press-fit pin according to claim 1 wherein said outer comers of the opposite, parallel beams are curved.

4. A press-fit pin according to claim 1 wherein said reentrant sections are arcuate and extend from said opposite ends of said lower surface of said deformable region.

5. A press-fit pin according to claim 4 wherein said arcuate reentrant sections do not extend below said lower surface of said deformable region.

6. A press-fit pin according to claim 4 wherein said reentrant sections are generally semicircular.

7. A press-fit pin according to claim 6 wherein said generally semicircular reentrant sections do not extend below said lower surface of said deformable region.

8. A press-fit pin having an elastically deformable area to be press-fitted in a plated through hole in a printed circuit board, the elastically deformable area having a cross section comprising:

two generally parallel, opposite flanges;

a web extending perpendicular to said flanges, said web having a flat upper surface and a flat lower surface, said flat upper surface and said flat lower surface having opposite ends;

said upper surface of said web joined to said flanges by two opposite sloping planar surfaces extending outward and upward from said opposite ends of said upper surface of said web; and said lower surface of said web having reentrant sections formed at said opposite ends of said lower surface of said web, and opposite sidewalls extending from said reentrant sections generally downward to be contiguous with said opposite flanges.

9. A press-fit pin according to claim 8, wherein said flanges have curved outer corners.

10. A press-fit pin according to claim 8 wherein said reentrant sections are arcuate and extend from said opposite ends of said lower surface of said web.

11. A press-fit pin according to claim 10 wherein said arcuate reentrant sections do not extend below said lower surface of said web.

12. A press-fit pin according to claim 10 wherein said reentrant sections are generally semicircular.

13. A press-fit pin according to claim 12 wherein said generally semicircular reentrant sections do not extend below said lower surface of said web.

14. A press-fit pin having an elastically deformable area to be press-fitted in a plated through hole in a printed circuit board, the press-fit pin comprising:

two generally parallel, opposite beams;

a deformable region extending perpendicular to said beams, said deformable region having an upper surface and a lower surface and said deformable region further having opposite ends between said beams;

said upper surface of said deformable region joined to said beams by two oblique sections extending outward and upward from said opposite ends of said upper surface of said deformable region; and said lower surface of said deformable region joined to said beams by reentrant sections formed at said opposite ends of said lower surface of said deformable region, and opposite sidewalls extending from said reentrant sections generally downward to be contiguous with said opposite beams and whereby said opposite sidewalls are generally parallel to each other.

15. A press-fit pin according to claim 14, wherein the beams have curved outer comers.

16. A press-fit pin according to claim 14, wherein the upper surface of the deformable region is at an intermediate level of the beam height.

17. A press-fit pin according to claim 14 wherein said reentrant sections are arcuate and extend from said opposite ends of said lower surface of said deformable region.

18. A press-fit pin according to claim 17 wherein said beams have curved outer comers, said upper surface of said deformable region is at an intermediate level of the beam height and said sidewalls extend downward and outward from said arcuate reentrant sections.

19. A press-fit pin according to claim 18 wherein said arcuate reentrant sections are generally semicircular.

20. A press-fit pin according to claim 17 wherein said generally semicircular reentrant sections do not extend below said lower surface of said deformable region.

21. A press-fit pin according to claim 20 wherein said beans have curved outer comers, said upper surface of said deformable region is at an intermediate level of the beam height and said sidewalls extend downward and outward from said generally semicircular reentrant sections.

* * * * *